US005764163A

United States Patent [19]

Waldman et al.

[11] Patent Number: 5,764,163

[45] Date of Patent: Jun. 9, 1998

[54] NON-IMAGING ELECTRO-OPTIC VEHICLE SENSOR APPARATUS UTILIZING VARIANCE IN REFLECTANCE

[75] Inventors: Gary Waldman; John R. Wootton; Asdrubal Garcia-Ortiz, all of St. Louis, Mo.

[73] Assignee: Electronics & Space Corp., St. Louis, Mo.

[21] Appl. No.: 531,467

[22] Filed: Sep. 21, 1995

[51] Int. Cl.[6] ..... G08G 1/065

[52] U.S. Cl. ..... 340/934; 340/933; 340/936; 340/942; 340/928; 340/555

[58] Field of Search ..... 340/933, 934, 340/936, 942, 905, 928, 555; 364/436, 437, 438; 235/384; 701/117, 118, 119

[56] References Cited

U.S. PATENT DOCUMENTS

| | | | |
|---|---|---|---|
| 3,436,540 | 4/1969 | Lamorlette | 340/942 |
| 3,532,886 | 10/1970 | Kruger, Jr. et al. | 340/933 |
| 4,398,172 | 8/1983 | Carroll et al. | 340/942 |
| 4,495,589 | 1/1985 | Hirzel | 364/565 |

*Primary Examiner*—Jeffery Hofsass
*Assistant Examiner*—Julie B. Lieu
*Attorney, Agent, or Firm*—Polster, Lieder, Woodruff & Lucchesi

[57] ABSTRACT

Apparatus (10) for monitoring vehicle (V) usage on a roadway (H). An AC light source (12) comprises either an incandescent or gas discharge light source. The light source has a detectable AC ripple in its output. The light source is mounted or installed above the roadway surface on a conventional light standard (16) or highway information standard (18) such that the light source directs its rumination downwardly onto the roadway. A light detector (34) detects light reflected from off the roadway. Light from the light source together with the collection optics of the light detector define a "footprint" (30) on the roadway surface and vehicles moving over the roadway pass over this footprint. The directed, reflected light has characteristics which are varied in response to passage of a vehicle over the roadway and through a path (X1, X2) of light between the source and detector. A processor (52) processes the reflected light and is responsive to variations in the characteristics of detected, reflected light caused by vehicle passage. The processor is capable of determining the number of vehicles passing over the roadway surface during a predetermined period of time, the speed of the vehicles, and the type of a vehicle. Further, the detector and processor are sensitive to changes in atmospheric conditions to adjust detection thresholds so the apparatus maintains its responsiveness to the passage of vehicles.

5 Claims, 5 Drawing Sheets

NON-IMAGING ELECTRO-OPTIC VEHICLE SENSOR APPARATUS UTILIZING VARIANCE IN REFLECTANCE

BACKGROUND OF THE INVENTION

This invention relates to apparatus for use in highway traffic control and employing vehicular traffic sensing, and more particularly, to a vehicle sensing apparatus utilizing a light source and associated sensing components to sense the presence of a vehicle, identify the type of vehicle sensed, the speed and direction of vehicle movement, and traffic flow rates and flow patterns of vehicles. The apparatus uses the sun and conventional highway light sources for vehicle sensing purposes.

The streets and highways which we use to travel from one place to another have been analogized to the human circulatory system. The major highways such as interstates correspond to arteries since they carry large volumes of traffic. The secondary four-lane roads can be considered arterials, and two-lane streets and roads capillaries. Traffic flow back and forth over these pathway have accordingly been likened to blood flow through our vessels. A slow down in traffic is analogous to some type of constriction in a vessel, and a complete stoppage as a clogged vessel. To carry the analogy a step further, modern traffic control systems, just like the human body, try to control the flow of traffic through this vast network, working through a constriction or clogging if possible; and if not, trying to work around it.

The realities of today's highway and road system is that the ability to add new roads, or even expand existing ones is becoming increasingly difficult. To build or expand a road through an urban area, for example, can cost more than twenty million dollars ($20 M) a mile. This includes land acquisition, tearing down existing structures, rerouting electrical, water, and sewer systems, and interrupting established traffic patterns (either for a short term or permanently) with all the entailed difficulties. This, all in addition to the typical tasks associated with constructing a four-to-ten lane thoroughfare. And, in suburban and rural areas, there is increasing reluctance to cover up more land with concrete or asphalt. As a result, there is a tendency to try to widen existing roads. This, however, involves complexities and problems similar to those for building new roads. For example, simply to add a lane (in each direction) to an already existing roadway can cost on the order of ten million dollars ($10 M) a mile.

Since the ability to add or expand to current road systems is becoming less and less feasible, managing traffic flow over existing roadways is becoming more and more important. Highway and traffic controllers are charged with the task of moving voluminous amounts of traffic over existing road systems. They do this in a variety of ways. The most common is the use of traffic control signals, such as stoplights, placed at intersections. Other strategies include flexible or changeable lanes. That is, lanes over which traffic flows in one direction during the morning rush hour, for example, and in the opposite direction during the evening rush hour. Another strategy is to limit access to certain roads during various times of the day unless a vehicle is carrying at least a prescribed minimum number of passengers. This is done to encourage carpooling at least over that stretch of roadway during those times. In many urban areas, rail systems are being built or expanded to provide an alternate means of transportation from home to the office and back. It is doubtful, however, that the number of vehicles using the roads will diminish at any time in the near future.

Besides simply controlling the sheer volume of traffic using the roads, there are related concerns effected by proper traffic control or the lack thereof. Cars sitting still in a traffic jam use gasoline (which is a non-replenishable energy source) and add pollution to the air without any tangible result; i.e., the vehicles just sit there. Slowed or stopped traffic, especially where there is no apparent reason such as an accident or other emergency situation, makes drivers irritable and can lead to accidents. Otherwise productive time is lost, and when the amount of time lost is considered for all the people caught in a jam, its value is significant. A separate concern is the speed of vehicles using a road. It is well understood that modern roads are designed to accommodate traffic traveling at speeds higher than a posted limit. However, if vehicles are traveling too fast, the probability of accidents occurring significantly increases. Knowing how fast vehicles are traveling allows highway controllers to take appropriate steps to keep speeds nearer to the posted limits and reduce the number of accidents.

It is well recognized that there is a need for better traffic control than is currently available. One approach to modern traffic control has been to determine how many and what types of vehicles use a particular stretch of road at any given time during a day. Studies have been conducted to determine the maximum capacity of a given road. For example, it is known that the maximum capacity of a traffic lane on an interstate or similarly constructed limited access high speed roadway is on the order of 2,500 vehicles an hour. With four lanes going in each direction, this means that at a peak traffic time such as a rush hour, 10,000 vehicles going in one direction could flow past any given point, assuming there was nothing to inhibit their flow. Similar information is available regarding the capacity of other types of roads. To determine actual utilization of road systems, vehicle sensor and recording systems have been used. One such system, for example, employs a recorder positioned adjacent the roadway and a cable which is stretched across the road. As cars pass over the cable, the recorder notes their passing. When left in place for a reasonable period of time, the system provides a useful traffic profile. This information can then be used by traffic or highway controllers to adjust or control the switching of stop lights at an intersection, for example. A stop light can be programmed so that at different times during a day, it will stay in a green or red condition longer than at other times. Or, it may be changed from green-yellow-red switching to a flashing yellow or flashing red at low traffic volume times such as late night and early morning.

Even though traffic profiling is useful, there is still the need to provide current traffic information to controllers. One system currently used involves embedding a magnetic loop sensor in the roadway. Such sensors sense passage of a vehicle by a change in their magnetic field as the vehicle passes by. There are however, a number of drawbacks to this type of system. For one, they are expensive to install and maintain. The cost of a typical installation is on the order of $800 and requires closing a lane of traffic, cutting a hole in the roadway, installing the loop, and fixing the roadway after installation. The State of Missouri, which is considered a low usage state, has 90,000 of these installations. In Toronto, Canada, there are 17,000 of these loops used along an eight mile stretch of road for traffic flow control purposes.

Second, magnetic loop sensors can be easily damaged and have to be replaced. Asphalt, for example, in which the loops are embedded, becomes a flowable material under very hot conditions. This can cause displacement of loops so they are no longer positioned to provide correct information. The variety of information provided by a sensor involves much more than just vehicle count. Which types of vehicle are using the road is also important. Sensing whether or not a road is heavily used by trucks, particularly tractor-trailer configurations commonly referred to as semis, provides an indication of how much traffic can use the road since larger vehicles tend to crowd out smaller vehicles such as passenger cars and the like. It also provides an indication of how soon road work must be done on a particular stretch of road because larger vehicles are not only heavier but tend to be very heavily loaded, and constantly subjecting the roadway to extreme amounts of weight increases roadway deterioration. Finally, roadwork typically causes destruction of the loops so they must be replaced when the roadwork is done.

Because it is recognized that the current sensing technology has deficiencies, other alternate technologies have been investigated. One such approach involves radar. Under this scheme, radar units operating in the millimeter (mm.) wavelength band would be located at strategic locations to sense the passage of vehicles. There are a number of drawbacks with this approach. One is that the radar units would be on constantly. This means that if traffic is slow or stopped adjacent a radar installation, people will be subjected to a constant stream of radar energy. Also, radar systems (as well as other systems) are subject to false alarms. The false alarm rate (FAR) effects the accuracy of a system in vehicle detection.

A second alternate approach employs acoustics. Here, a sonic wave is transmitted at the roadway, and reflected energy is sensed and processed to obtain vehicle information. A problem with this approach is again high false alarm rates because of the possible multiple paths by which acoustic energy is reflected back to a sensor. A third proposed approach is an optical or imaging solution. Here, a camera is positioned so it can view the traffic. The images presented to the camera are then processed to obtain the relevant information. There are several problems with this approach. For example, viewing conditions are not always perfect, and the quality of information derived is greatly dependent upon such conditions. Regardless of the particular approaches being considered, a main consideration is that because of the large number of installations involved, the cost of implementing any particular system will be enormous. Consequently, what is required is a simple, reliable, relatively maintenance free system that will not be effected by road work or the like, and which is sufficiently low cost that even when installed in numerous locations, the system is relatively inexpensive.

SUMMARY OF THE INVENTION

Among the several objects of the present invention may be noted the provision of apparatus for sensing vehicular traffic passing over a road;

- the provision of such apparatus to be readily installed in any of numerous locations, the installations being above-the-road installations which do not require any preparatory or other work be done to the road surface and which installations are not effected by subsequent work done on the road surface after installation;
- the provision of such apparatus to be readily removed from one installation to a new installation, if required;
- the provision of such apparatus which is a non-imaging vehicle counter and classifier capable of readily identifying the passage of vehicles, classifying the passing vehicles as to vehicle type; i.e., passenger car or van, single unit trucks or medium size buses, or large tractor-trailer units (semis) or large buses;
- the provision of such apparatus to employ a sensor sensitive to changes in ambient light conditions and changes in light reflected off the surface of a road to detect the passage of a vehicle;
- the provision of such a sensor to determine the length of a vehicle as a function of the amount of time a change from ambient conditions occurs;
- the provision of such apparatus to employ separate sensors arranged in tandem so as to ascertain the speed and acceleration of a vehicle passing beneath the sensors;
- the provision of such apparatus to employ separate sensors for each lane of a multi-lane road so to effect complete coverage of vehicles passing over the road;
- the provision of such apparatus to establish a baseline as a function of current ambient conditions and to periodically update the baseline to take into account changes in the ambient conditions, i.e., full sun to clouds, day to night, etc.;
- the provision of such apparatus employing light sensors which define a footprint for each lane sufficiently large so as to detect every vehicle passing over the road even if the vehicle is to one side of the lane;
- the provision of such apparatus employing a single light source but multiple detectors for obtaining desired vehicle information;
- the provision of such apparatus wherein the footprints defined for adjacent lanes are sufficiently close together that a vehicle changing lanes as it is passing beneath the sensors will still be detected;
- the provision of such apparatus for determining when vehicles are queued and the length of a queue;
- the provision of such apparatus in which the footprints are a function of a light detector and the detector optics;
- the provision of such apparatus to be sufficiently impervious to extraneous light sources such as the headlights of an approaching vehicle to still be able to detect the vehicle;
- the provision of such apparatus to be installed on existing light standards mounted beside roadways so as to be positioned over the roadway and to not require separate supports;
- the provision of such apparatus employing a highway light source operating in the visible or portion of the light spectrum;
- the provision of such apparatus to further use a conventional highway light source installed on the standard as a light source by which the apparatus detects vehicles so that no additional source is required for the apparatus to properly function;
- the provision of such apparatus to utilize certain characteristics of the existing light source for vehicle sensing purposes; and,
- the provision of such apparatus which is low cost, relatively maintenance free, and highly reliable.

In accordance with the invention, generally stated, apparatus is provided for monitoring vehicle usage of a road. An AC light source can be either an incandescent or gas discharge luminary, and has a detectable AC ripple in its output. The light source is mounted or installed above the roadway on a conventional light standard or on a highway sign that extends across the roadway. Regardless, the light source is mounted such that it directs its rumination downwardly onto the road. A light detector and its collecting optics define a "footprint" on the roadway. Vehicles moving over the road pass over this footprint. The light detector detects light reflected off the surface of the road, this reflected light having characteristics which vary in response to passage of a vehicle over the roadway and impinging upon a path of light between the source and detector. A processor processes the reflected light and is responsive to variations in the light characteristics caused by vehicle passage. The processor is capable of determining the number of vehicles passing over the road during a predetermined period of time, the speed and acceleration of the vehicles, and the type of vehicle. The apparatus is sensitive to changes in atmospheric conditions such as day, night, clouds, rain, snow, etc., to adjust vehicle detection thresholds so the apparatus remains sensitive to the passage of vehicles over the roadway regardless of the time of day or atmospheric conditions. A method of vehicle sensing is also disclosed. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENTS

Figure 9:
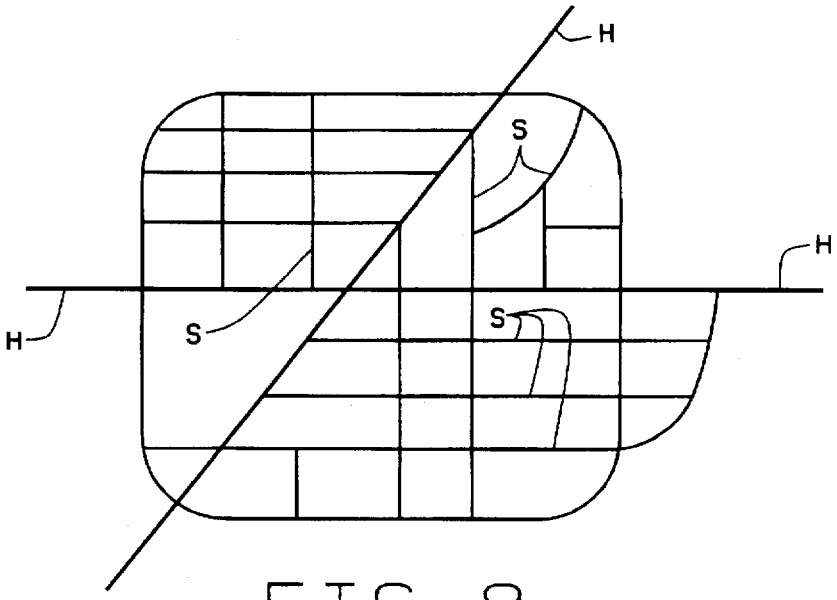
FIG. 9 is a simplified representation of a road system over which traffic flow is to be controlled.

Referring to the drawings, a highway H is shown to be a multi-lane highway. In the example shown in the drawings, highway H is a six-lane highway having three lanes indicated L1–L3 for traffic traveling in one direction, and another three lanes L4–L6 for traffic traveling in the opposite direction. In addition, the highway is shown to have access ramps for traffic ingressing and egressing from the highway. The ingress or "on" ramp is indicated R1 and an egress or "off" ramp is indicated R2. It will be understood that vehicular traffic travels over a wide variety of roadways including highways having four, six, or more lanes, two lane roads, and roads used by traffic traveling in only one direction. A road system such as shown in FIG. 9, encompasses various combinations of these roads. In FIG. 9, major thoroughfares such as interstates or main highways are designated H, while city streets and similar roads are designated S. Since the possibility for expansion of such a road system is limited, it is becoming increasingly necessary to better control the flow of traffic over roads comprising the existing road system. Accordingly, in order for the efficient flow of traffic over the road system, traffic controllers require information about traffic volume, particularly at peak times of usage. Road usage rates for different types of roads have long been established. These rates are typically expressed as so many vehicles per hour and depend upon such factors as the number of lanes a road has, the number and frequency of stop lights or other traffic controls, etc. To assist traffic controllers in overseeing the flow of traffic on the road system, an apparatus 10 of the present invention is provided. As described hereinafter, the apparatus is helpful in performing a number of functions. First, the apparatus is useful in providing information concerning the flow rates of vehicles or the volume of traffic using a road, and can do so both during the day and at night, and during a wide variety of atmospheric conditions. Besides the volume of traffic, the apparatus also provides information on the speed of vehicles and vehicle acceleration. Also, the apparatus can distinguish between the types of vehicles using a road. This enables the controllers to profile road usage as between passenger cars and vans at one end of the spectrum, and large, over-the-road trucks at the other end. Profile information is important, not only for flow control purposes, but also to help highway personnel determine which portions of the road system are most heavily used since these portions will be requiring more frequent maintenance. Also, a section of road having a high volume of truck usage will typically require more frequent repair than sections where usage is predominantly lighter weight vehicles such as passengers cars.

Figure 10A:
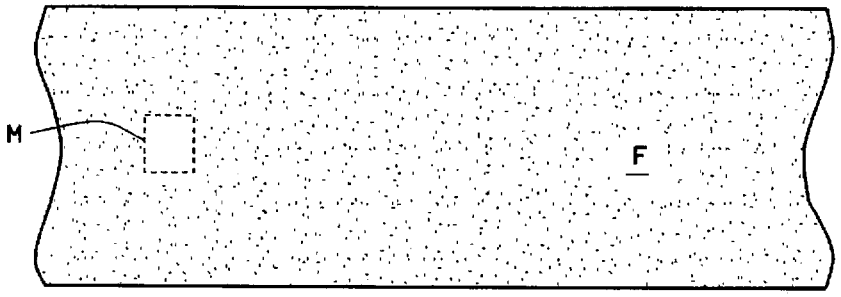
FIG. 10A is a top view of a roadway surface and illustrates a prior art sensor installation.
Figure 10B:
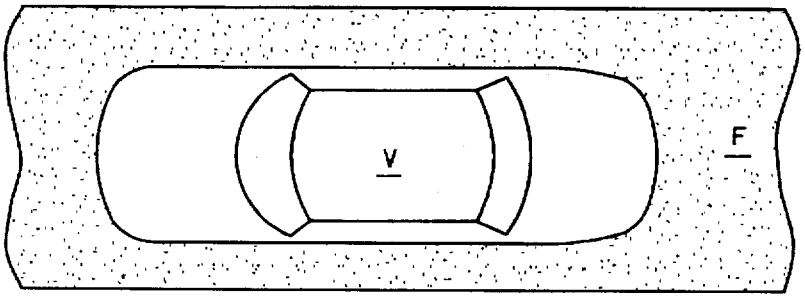
FIG. 10B illustrates passage of a vehicle over the surface.

Apparatus 10 is a non-imaging system which provides not only certain cost advantages over existing systems and proposed alternative systems, but also is a system that is highly reliable, provides accurate information even under extreme conditions, and requires low maintenance. The premise upon which apparatus 10 operates is that a roadway, when viewed from above, presents a generally unvarying target for light radiation, regardless of the light source. Such a road surface is indicated generally F in FIG. 10A, and has certain light reflectance characteristics and a known geometry. When a vehicle V passes over a portion of the road surface, the light reflectance characteristics and geometry change momentarily. This is shown in FIG. 10B. The significance of this is that passage of a vehicle is readily discernible. As previously noted, current vehicle sensing technology employs a magnetic loop M. The passage of a vehicle over the loop momentarily effects the magnetic field produced by the loop and this sensed change signifies passage of the vehicle. Drawbacks to use of magnetic sensors, as previously discussed, include their cost and susceptibility to damage.

Figure 1:
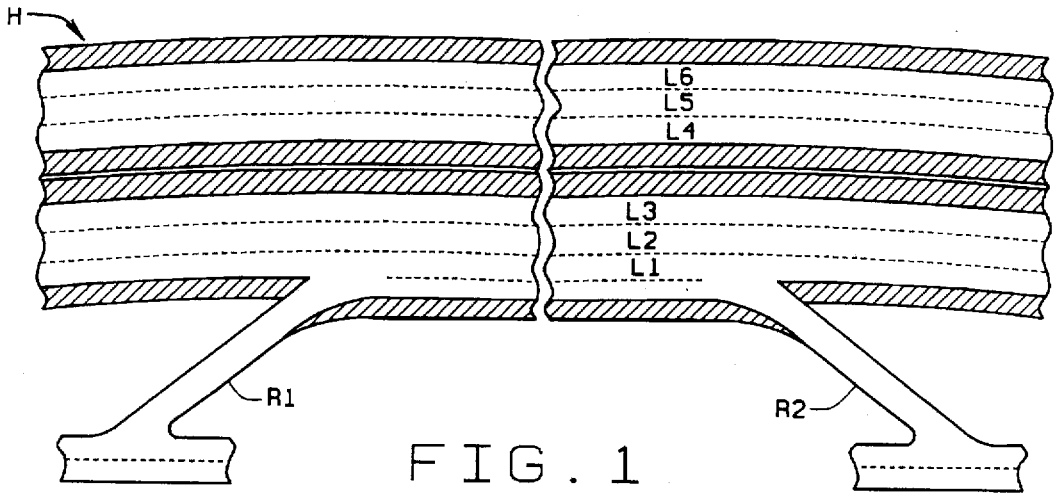
FIG. 1 is a representation of a highway illustrating various design considerations involved in the construction of the highway and in the design of a vehicle sensing apparatus for use on the highway.
Figure 2:
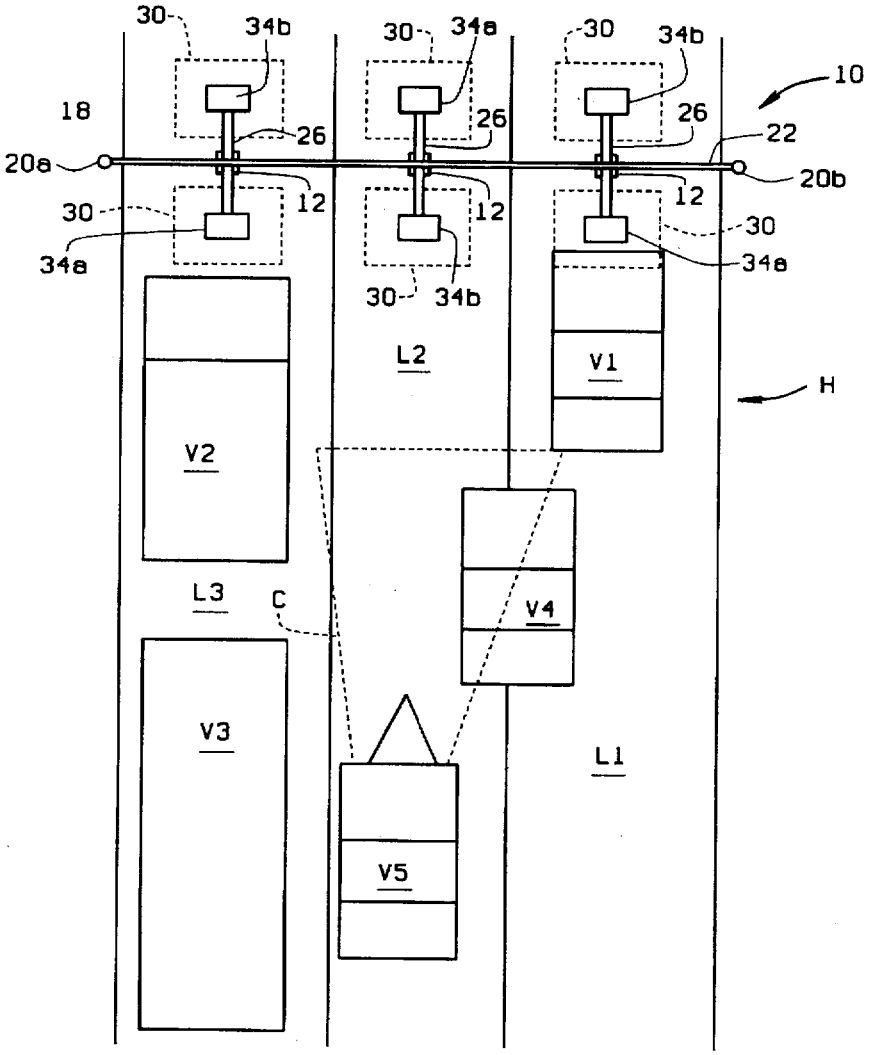
FIG. 2 is an overhead view of a highway segment over which vehicles of different types are traveling, and illustrating a portion of the apparatus of the present invention for sensing the passage of vehicles.
Figure 3:
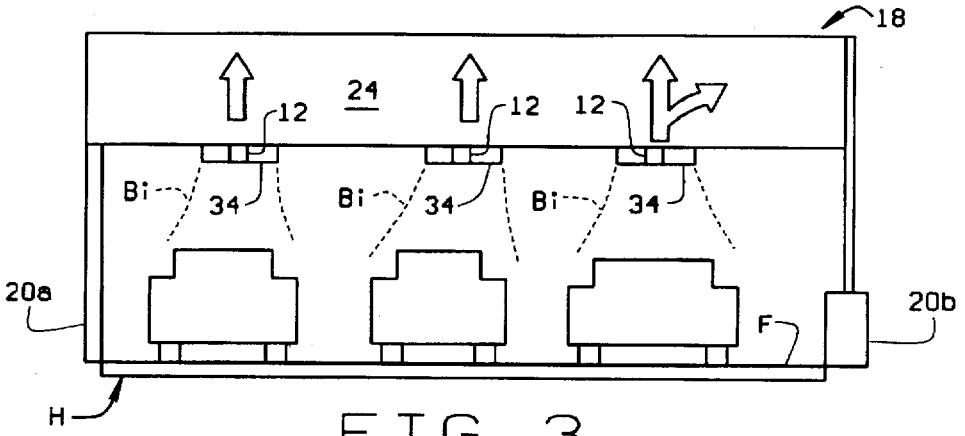
FIG. 3 is an elevational view of the highway segment of FIG. 2 and illustrating installation of a light source and detector of the apparatus.
Figure 4:
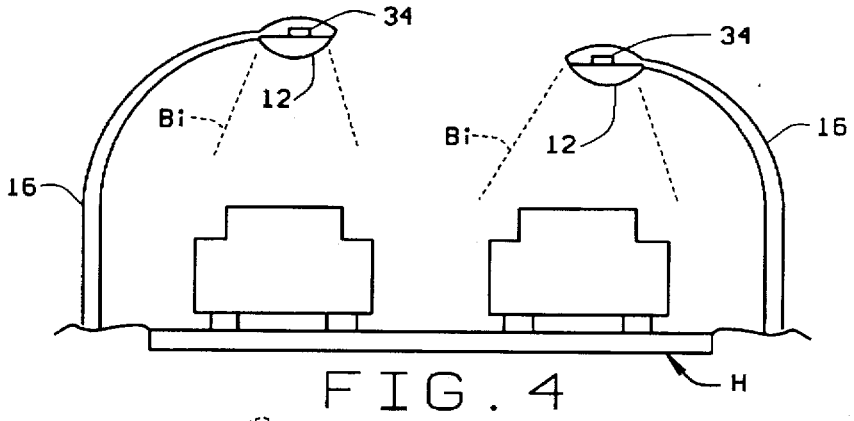
FIG. 4 is a view similar to that of FIG. 3 and illustrating an alternate light source installation.
Figure 5:
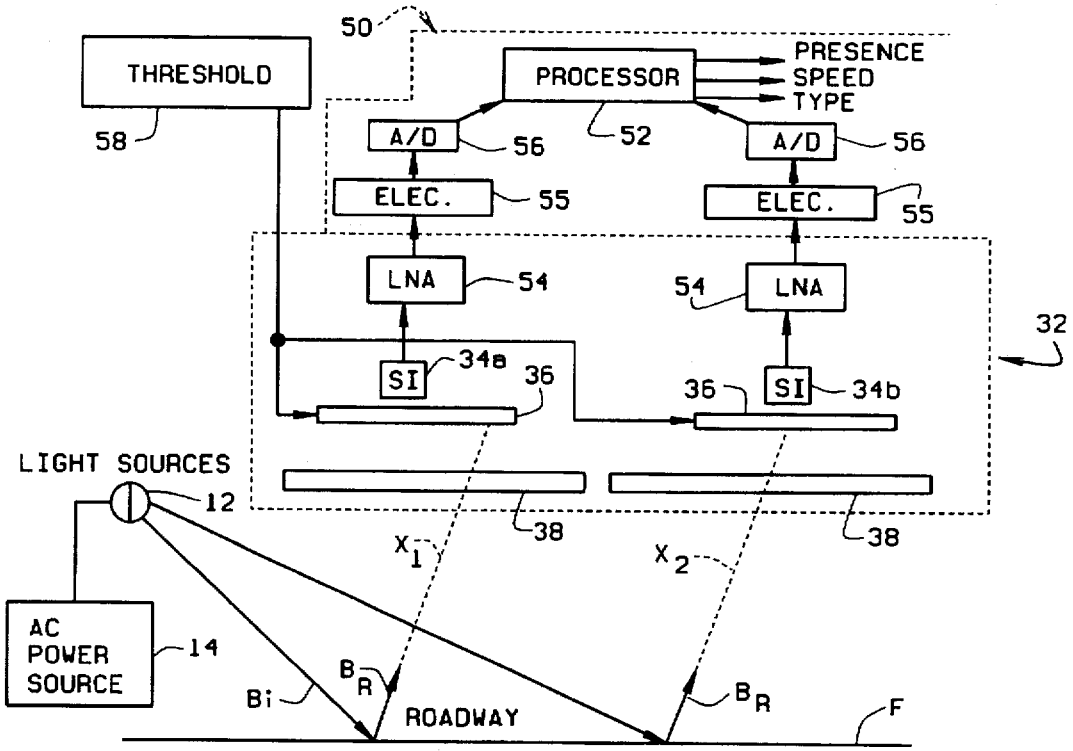
FIG. 5 is a block diagram representation of signal processing apparatus of the invention.

Referring to FIGS. 2–5, apparatus 10 first employs a light source 12. It is a feature of the light source that it can be one of a wide variety of light sources depending upon a particular application. For example, the light source can produce light in either the visible or infrared portion of the light spectrum, particularly the near infrared portion of the spectrum. The light source can either be an incandescent light source, or one of a variety of gas discharge type light sources. Fluorescent, mercury vapor, and high pressure sodium vapor are but three types of gas discharge light sources which can be employed in accordance with the teachings of the invention. As shown in FIG. 5, regardless of the particular light source used, the light source is powered from an AC power source 14. The power source is 115 VAC, 60 Hz line voltage, for example. As shown in FIGS. 2–4, highway H is typically a multi-lane highway, and there is at least one light source used with each separate lane for sensing the passage of a vehicle. It will be understood, however, that fewer light sources could be used so long as there are enough light sources to avoid shadows. This is as shown in FIGS. 2–4. A particular advantage of the invention is that light sources 12 are conventional sources typically used in a highway lighting system. These lights are AC powered lights and usually are operated from dusk to dawn to illuminate on-ramps, off-ramps, intersections, and highway signs. In the operation of apparatus 10, the lights would be operated around the clock. Alternatively, the lights would be operated at times of low light conditions such as occurs, for example, when the sun is low on the horizon and the resultant shadows produced by a vehicle could extend from one lane into another. The cost of the additional power required to operate the lights is offset by the usage of standard units.

Regardless of the number or type of light sources used, each light source is separately mounted above respective lanes of the highway. As shown in FIGS. 3 and 4, there are a number of ways for installing the light sources. As shown in FIG. 4, light standards 16 such as are conventionally used to mount roadway lights over roads, can be employed. Or, as shown in FIG. 3, the lights can be supported from highway signage indicated generally 18 such as is used to indicate the distances to upcoming exits, which lanes should be taken to travel which roads. The use of light standards 16 is generally adaptable to roads having two lanes, for example; whereas, signage 18 installation is used with highways having two or more lanes in each direction. Signage 18 typically includes a vertical post 20*a*, 20*b* erected on each side of the roadway. One or more cross-members 22 (usually at least an upper and lower cross-member) extend between the posts. A sign 24 containing the relevant information is then mounted on, or is attached to, this support structure. A light source 12 is mounted or attached to the lower cross-member 22 to direct its light downwardly onto the road surface. Preferably, the light sources are aligned with the longitudinal centerline of the respective lanes. Now, with light from each light source directed downwardly onto the surface of the highway, incident light from each source is reflected off the highway surface. The light sources are installed sufficiently high above the roadway so as not to interfere with, or be interfered with, passing traffic. For example, the light sources are installed approximately seventeen feet (17', 5.8 m.) above the roadway.

It is important for operation of the apparatus that an incident light beam Bi from any light source will have a set of characteristics which will be effected by the passage of a vehicle. With respect to the light sources powered from AC power source 14, the light emitted by the sources includes an AC ripple A of a known frequency (see FIG. 6). This natural modulation provides certain advantages. In particular, artificial lighting powered from an AC light source offers a method of discriminating against sunlight in the daytime, and approaching vehicles at night. If the natural modulation of artificial lighting is not used, then vehicle headlights could cause double counting at night, even though a sensor is looking vertically downward. One reason for this is because vehicle headlights create a spot on the roadway surface a distance ahead of the vehicle. Diffuse reflection from the pavement could send sufficient light upward to cause a sensor to register passing of the spot as a vehicle. Headlights of vehicles are, however, powered by car battery which is a DC power source. The light sources have a 120 Hz ripple A in their light output. For incandescent lights, this ripple is on the order of a few percent. For gas discharge lights, the modulation is substantially greater. In a fluorescent lighting fixture, this modulation is on the order of 40%. For mercury vapor and high pressure sodium vapor roadway lighting fixtures, the modulation is approximately 80%. Accordingly, sensing of vehicle passage can be detected using the AC ripple component of incident light from a light source 12.

Figure 12:
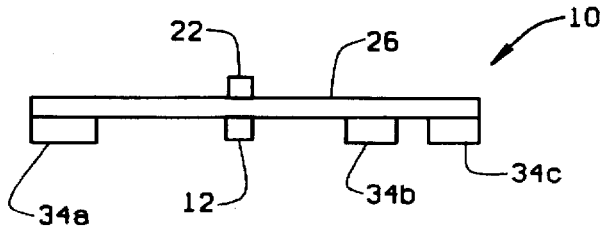

Apparatus 10 next includes a detector means 32 for detecting light reflected off surface F of the roadway. If a single light source 12 is used, then detecting means 30 employs a single light detector 34. If a pair of light sources are employed, detector means 32 includes a separate light detector 34*a*, 34*b* respectively for detecting a reflected light beam Br. Or, as shown in FIG. 12, three detectors 34*a*–34*c* can be used with a single light source 12. Preferably, light detectors 34 are silicon photodetectors which, as shown in FIGS. 2–4, are mounted on the same light support fixtures upon which the light sources are mounted. The reflected light detected by the photodetectors includes the AC ripple. The amplitude of the ripple in the light reflected off the road surface is varied in response to passage of a vehicle over the highway (see FIG. 7) and through respective first and second light paths X1 and X2 (see FIG. 5). These paths extend from the respective light sources to the respective detector means.

A silicon photodetector such as detectors 34 has the advantage of being relatively inexpensive and highly sensitive to light in the visible and near infrared portions of the light spectrum. These photodetectors are available in many configurations. Smaller size photodetectors have an advantage of advantageous signal-to-noise ratios (SNR). However, these detectors have smaller fields of view (FOV); i.e., smaller footprints 30. Silicon has a spectral response curve extending from approximately 300 nm up to approximately 1100 nm. This curve has a peak near 800 nm.

The incident light from a light source 12 is directed generally vertically downward. As shown in FIG. 2, individual areas or "footprints" 30 are created on the highway surface. Each individual footprint 30 results from a light source 12 and a detector 34*a*, 34*b* with its associated optics. The size of the footprint is such that it describes an area on the surface sufficiently large that movement of a vehicle over the roadway is detected. In FIG. 2, three lanes L1–L3 of highway H are represented. In lane L1, a first vehicle V1 is shown traveling generally centered in the lane. The width of footprint F over which this vehicle is passing is sufficiently large that vehicle passage is readily sensed. So is the passage of the larger vehicles V2 and V3 in lane 3. A vehicle V4 is shown in the act of changing position from lane L1 to lane L2. This vehicle is shown as straddling the two lanes. Even if the vehicle maintained this position while driving beneath the respective light sources, the footprints are sufficiently large that vehicle will pass over a portion of at least one if not both sets of footprints in lanes L1, L2. Accordingly, the passage of the vehicle will be readily detected as discussed hereinafter. Finally, a vehicle V5 is depicted in the center lane of FIG. 2 approaching the apparatus. This vehicle is also shown as having its headlights on so that they cast a beam C in front of the vehicle. As previously mentioned, and as discussed hereinafter, the presence of beam C has no effect on the ability of the apparatus to detect either vehicle V5 or any vehicle, such as the vehicle V4, off of which beam C is reflected.

It will be appreciated that in order to most advantageously detect the presence of a vehicle, there should be an abrupt transition in the input to a photodetector when a vehicle passes over a footprint on the roadway surface created by an incident beam of light from one of the light sources. Accordingly, a narrow bandwidth spectral light filter 36 is mounted in front of each photodetector. As shown in FIG. 5, a lens or other type of collecting optics 38 is positioned in front of the photodetector. The spectral filter 36 is positioned between the collecting optics and the photodetector. A spectral filter is used because, otherwise, a broadband sensor response could produce an averaging effect between one instant when no vehicle is present in the field-of-view (FOV) of the detector, and the next instant when a vehicle is present. A decrease in reflectance in one portion of the spectrum could cancel out an increase in spectral response in another portion of the spectrum. This, effectively, would prevent the photodetector from sensing a change in the FOV. Using a narrow bandwidth filter, this spectral averaging is eliminated and the response of the photodetector to the entry of a vehicle in the FOV produces a desired abrupt change as particularly shown in FIG. 7. The spectral filters 36 used with the photodetectors are, for example, 10 nm wide. The center of the filter bandwidth is chosen to match both the spectral frequency or spectral band of the light source and the response band of the photodetector.

With respect to the collecting optics or lens 38, it is advantageous to focus reflected light radiation onto the photodetector. A preferred lens to accomplish this is a Fresnel lens. Such lenses are made of plastic and have a light transmission capability of 92% over the spectral range from 400 nm to 1100 nm. In addition to being a low cost, lightweight lens, Fresnel lenses are available in a wide range of focal lengths, and very low F numbers are available for such lenses. While it is advantageous to use a large aperture to gather more power, a short focal length lens produces a relatively large FOV. That is, the shorter focal length increases the size which a footprint 30 can be on the roadway. For a photodetector 34 having, for example, square optics, the FOV of the photodetector is determined by the equation:

$$FOV=2\tan^{-1}(\sqrt{A}/(2EFL))$$

where A is the area of the photodetector, and EFL is the effective focal length of the collecting optics. For example, photodetector 34 could employ a 20 $mm^2$ collection area. If Fresnel lens 38 has an aperture of 2 inches (50.8 mm.) and an effective focal length of 1.3 inches (33 mm.), then use of the above equation produces a FOV of 7.75°.

Figure 11:
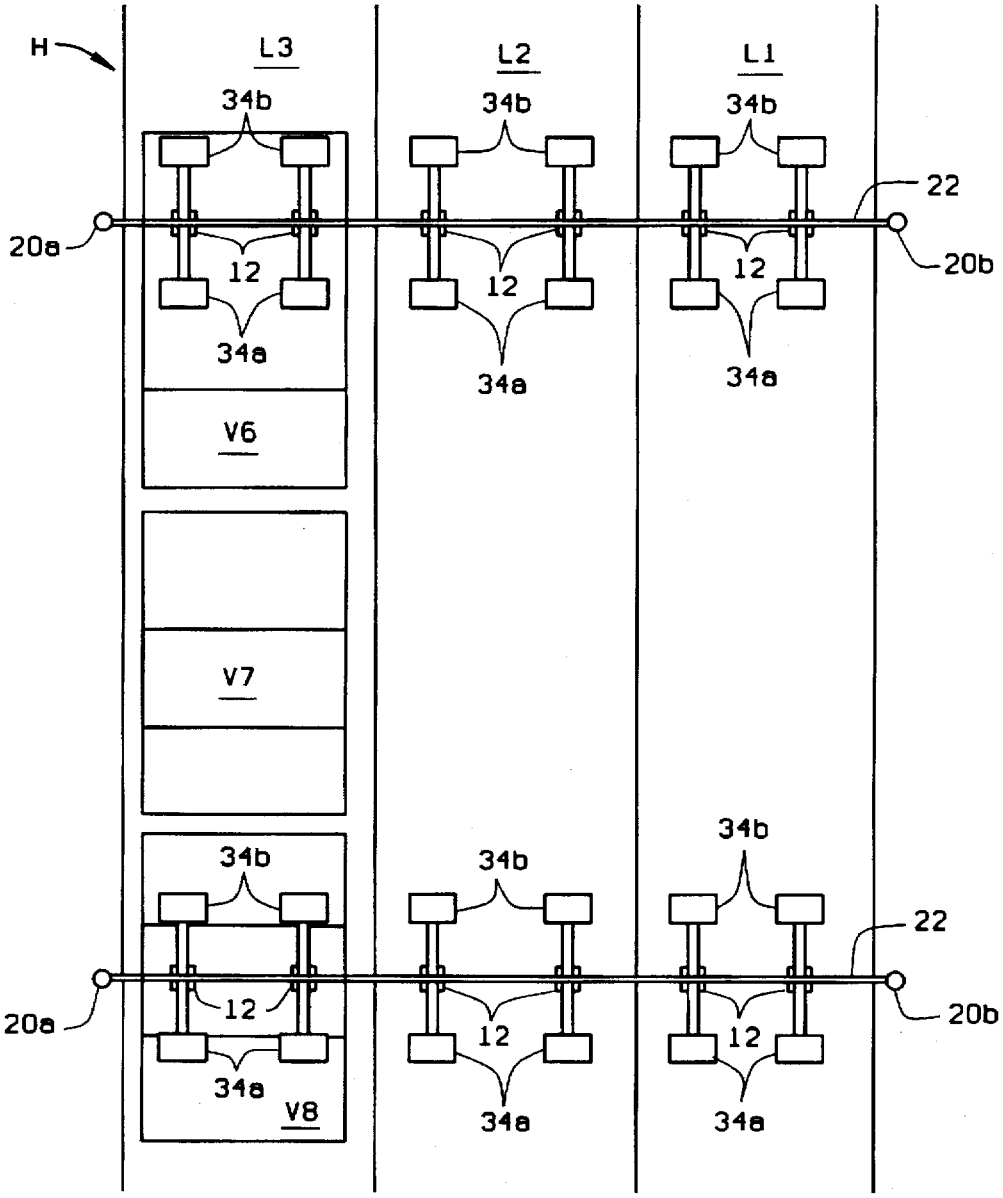
FIG. 11 represents an alternative light source and detector arrangement using additional photodetectors in each lane of a highway to detect a queue of vehicles; and, FIG. 12 represents a light source employed with three separate detectors for sensing vehicle acceleration in addition to vehicle presence, speed, and type.

To achieve this, collector 34 would be installed at a height of 17 feet (5.8 m.) above the surface of the roadway to comply with minimum clearance requirements for the vehicles using the road. For this height and with the FOV value as set forth above, this implies a footprint 30 which is 2.3 feet by 2.3 feet. Standard width of highway lanes is 12 feet. With the photodetectors centered on the lanes, the separation between the near edges of adjacent footprints is 12–2.3=9.7 feet. The maximum width of a vehicle V is approximately 8.5 feet, and the minimum width is approximately 6.5 feet. The effect of this is that a vehicle V will not be able to be detected by two sensors simultaneously. There is, however, a possibility that a vehicle such as vehicle V4 straddling two lanes or running along a shoulder of the road might not be detected. This possibility could be eliminated by using additional sensors as indicated in FIG. 11. Here, two sets of light sources and detectors are arranged in parallel in each lane. Although the sets are spaced apart, the spacing is such that the possibility of a vehicle avoiding detection is substantially eliminated.

Photodetectors 34 typically have a specification of normalized equivalent power. When this value is multiplied by the square root of bandwidth, the result is a value referred to as noise equivalent power or NEP. This noise equivalent power is the photodetector input power necessary to produce a signal-to-noise ratio (SNR) of unity. Accordingly, $$SNR=\Delta P/NEP=\Delta P/(NEP*\sqrt{\Delta F})$$

where ΔP represents the change in incident radiant power to be detected.

For a diffusely reflecting (Lambertian) surface, incident power P is determined as $$P=((\rho\tau_o D^2 FOV^2)/4)*E_s$$

where p=scene reflectance $\tau_o$=optics transmission

FOV=field of view (in radians)

D=optics entrance pupil diameter (m)

$E_s$=scene irradiance ($W/m^2$)

Some applicable values used in making this determination are ρ≈0.33 at 550 nm for aged concrete, for example. In addition, $\tau_o$≈0.46 (or 0.92 for a Fresnel lens *0.5 for a peak of a spectral filter). In addition, FOV≈0.135 rad., and D≈0.0508 m. Using these values in the above equation, P is calculated to be $1.8*10^{-6}$ $E_s$. The value of scene irradiance is a function of source illumination. The surface level AC amplitude of irradiance has been measured using a 10 nm. wide spectral filter for both mercury vapor and high pressure sodium vapor roadway light sources. The light sources were placed between 20 ft.–25 ft. above the roadway surface. A filter 36 was used, this filter having a bandwidth centered at 632 nm. In actuality, the scene reflectance ρ is closer to 0.35 than 0.33 at 632 nm. In practice, if a mercury vapor light is used, then a filter 36 is used at 546 nm, which is a mercury line with a mercury vapor light, In either instance, the amplitude of detected light obtained is on the order of 5 $mW/m^2$. This value is increased if the light source is lowered to the 17 foot height previously discussed; or, if the center of the filter bandwidth is optimized for the light source. When this irradiance is used for $E_s$, the incident power P is on the order of 10 nW. While this level of power is relatively small in absolute terms, it is a relatively large level compared to the NEP for a silicon photodetector at a 100 Hz bandwidth. A 20 $mm^2$ photodetector has a noise equivalent power of less than $1.6*10^{-13}$ $W/Hz^{1/2}$. For a bandwidth of 100 Hz, this implies a NEP of $1.6*10^{-12}$ W. Consequently, even if a power change is very small with respect to the baseline power, the SNR value can still be quite large. And, as described hereinafter, a low noise amplification is provided with respect to these small changes in power. If detection is to be accomplished for a 1% change in a baseline power 10 nW, then $\Delta P \approx 10*10^{-11}$ W. Importing this value into the above equation, the calculated signal-to-noise ratio is 60.

An electronic filter 55 has a bandwidth which determines the resolution times obtainable using the apparatus. The resolution time $\Delta t$ is roughly the reciprocal of the filter bandwidth $\Delta f$. For apparatus 10, one of the operating parameters of the system, vehicle length, is directly proportional to time of resolution. The minimization of bandwidth is desirable because of the rejection of unwanted signals; however, a narrow bandwidth has poor time resolution. Accordingly, in determining the particular filter 55 to be used for a particular configuration of the apparatus, a trade-off must be made between these two operating characteristics. It will be understood; however, that electronically filtering received energy in the frequency domain (and also spectrally) facilitates selection of the reflected energy from the modulated light source, and also facilitates rejection of interference (unmodulated) light sources such as sunlight and vehicle headlights.

With a center frequency of 120 Hz for the light source ripple, a 100 Hz. bandwidth is feasible. This bandwidth would, for example, encompass the frequency range from 70 Hz.–170 Hz. For this condition, the resolution time of the detection means is on the order of 0.01 sec. At speeds of 100 miles per hour, a vehicle is traveling at approximately 147 feet per second. For a 0.01 sec. resolution time, the apparatus is capable of sensing vehicle lengths to a resolution of 1.5 ft. Since one of the functions of the apparatus is to enable classification of vehicles, this degree of resolution is sufficient based upon the classification criteria upon which design of the apparatus is based and which is discussed hereinafter. The bandwidth also has implications with respect the signal-to-noise ratio (SNR) obtainable with a photodetector 34.

Apparatus 10 next includes a processing means 50. The processing means includes a processor 52 for processing the reflected light detected from the respective pairs of light sources 12 and variations in the AC ripple in the light output from these sources by passage of a vehicle through the footprint beneath the light source. Detector means 32 includes a low noise amplifier (LNA) 54 for amplifying the output from the respective photodetectors. These output signals are analog signals. Processing means 50 includes analog-to-digital (A/D) converters 56 to convert these analog signals to corresponding digital signals for use by the processor 52. Processor 52 processes the digital input signals to produce respective outputs which are indicative of the passage of a vehicle, the vehicle type, and the vehicle's speed. This information is supplied to traffic controllers to enable them to monitor traffic flow over a road system and redirect traffic as appropriate.

It will be appreciated that the light threshold conditions which represent a vehicle detection baseline are variable depending upon changes in ambient light conditions, the transition from day to night and vice versa. Detection means 32 includes threshold setting means 58 which effects the baseline for the filter 36 and photodetector 34. This threshold setting varies the response of the detection means to atmospheric changes from bright sunlight through various degrees of cloudiness, as well the transition from daylight into darkness and darkness into daylight. Detection of a vehicle is basically detection of a threshold crossing within the detection means. Two thresholds are set. One is on one side of the baseline signal, and one on the opposite side. Processing means 50 treats any threshold crossing as a potential entry of a vehicle into the footprint 30 on the road surface. Double thresholding is involved because it is not known, in advance, whether entry of a vehicle into the footprint will increase or decrease radiation received by a photodetector 34. A threshold crossing caused by noise alone is known as a false alarm. These are caused by random variations in the signal received by the photodetector. Failure of a change in radiation to produce a threshold crossing, caused by passage of a vehicle through the footprint, is referred to as a missed detection.

A false alarm rate (FAR) is the average number of false alarms per unit time. A probability of detection (Pd) is the probability that a passing vehicle causes a threshold crossing. The values of these quantities are determined in relation to the setting of the threshold and the root mean square (rms) of the noise level, and in relation to the signal level above or below the baseline. With respect to false alarm rate:

$$FAR=(2/(\Delta f\sqrt{3}))exp(-\tfrac{1}{2}TNR^2)$$

where TNR≡threshold to the rms signal-to-noise ratio. The factor of 2 results from the double thresholding and that the noise voltage can be either positive or negative, depending upon the direction in which a false alarm occurs. The probability of detection is given as follows:

$$P_d=\tfrac{1}{2}[1+erf((SNR-TNR)/\sqrt{2})].$$

Use of the above equations allows the setting of a threshold for an acceptable FAR, and then the calculation of a probability of detection. Using the previously defined signal-to-noise ratio (SNR) of 60, an FAR value of less than one a day is achieved, and the resulting probability of detection, one or unity. It will be understood that the above calculations take into account only the noise associated with a detector 34. Noise from other sources such as vibration of the detector footprint, power line noise, etc., may cause some degradation in performance. Nonetheless, the above calculations include a margin sufficient to provide an apparatus 10 having an FAR of 1/day, and a probability of detection ≧0.99 for the 1% change.

Figure 6:
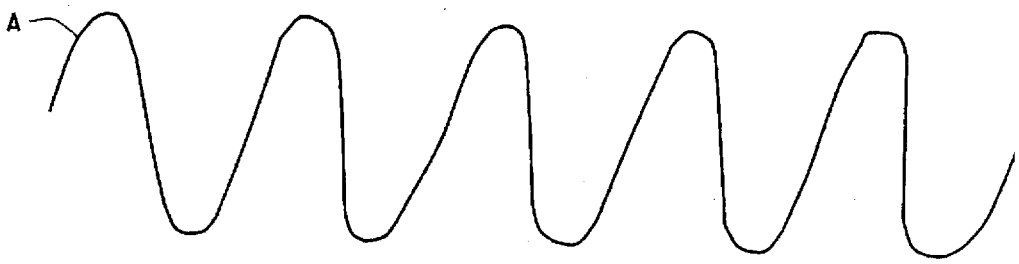
FIG. 6 is a sine wave of a known frequency which is a characteristic of the light source used with the apparatus to obtain vehicle usage information.
Figure 7:
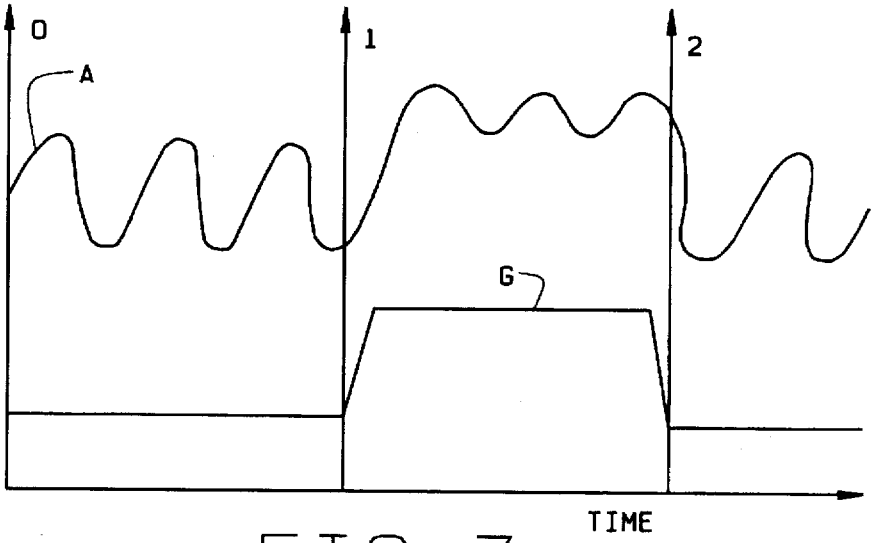
FIG. 7 is a representation of a response waveform from detection of a vehicle, both as received and as processed by the apparatus.
Figure 8:
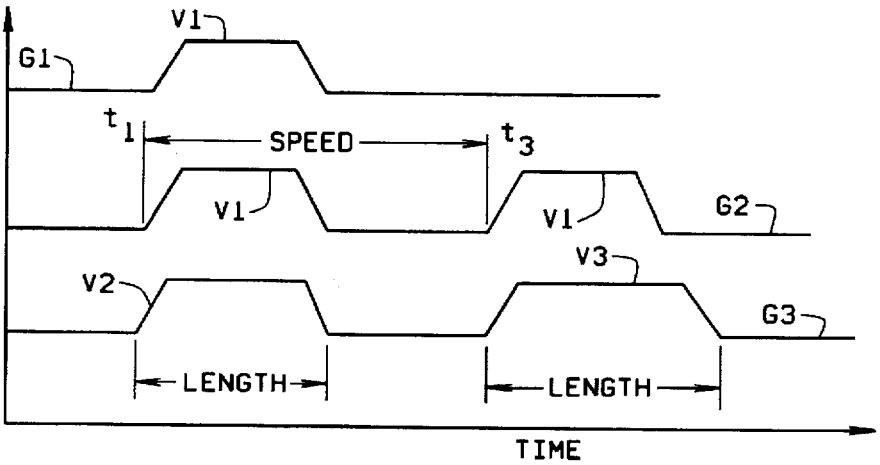
FIG. 8 illustrates vehicle presence and vehicle usage information obtained from the processing of various vehicle response waveforms.

Referring to FIGS. 6–8, light source 12, as noted includes a 120 Hz ripple. Processing of this ripple involves detecting when the change in signal amplitude occurs, both when a vehicle enters the footprint, and when it leaves. And, the duration of the change in amplitude. In FIG. 7, a time line extending from a time $t_0$ to a time $t_2$ is established. This time line and the ripple pattern A represent a decrease (or an increase) in the amplitude of the ripple caused by passage of a vehicle V over a footprint 30 on the highway surface. Whether there is a decrease or an increase in the ripple amplitude is dependent upon the light reflection characteristics of the vehicle. From time $t_0$ to time $t_1$, the ripple is shown to be a steady state, indicating that no vehicle is impinging on the footprint. At time $t_1$, and extending to time $t_2$, a vehicle passes over the portion of the highway where the footprint is created. This is shown as a decrease (or an increase) in the ripple amplitude which begins at time $t_1$, and continues until time $t_2$. After passage of the vehicle, the amplitude of the ripple returns to its baseline value. Also shown in FIG. 6, is the output from the low noise amplifiers 54. This signal, indicated as G in FIG. 7, shows a constant amplitude level from time $t_0$ to $t_1$. During this interval, no vehicle passes over the footprint on the highway surface. At time $t_1$, when a vehicle enters the footprint, there is a ramp-up from this baseline to a second and higher level. As the vehicle leaves the footprint immediately prior to time $t_2$, the signal falls from this second, higher level, back to its initial baseline value.

Processing by processor 52 involves the evaluation of the digital conversion of signal G. As shown in FIG. 8, the passage of a vehicle is indicated by the change in amplitude of the signal. This is indicated by the signal G1 in FIG. 8. The speed of the vehicle is a function of the time it takes for the vehicle to move between one footprint and the tandem footprint created by a respective pair of detectors 34*a*, 34*b*. Thus, as shown with respect to curve G2 in FIG. 8, a vehicle V1, for example, impinges on the footprint 30 of a detector 34*a* at time $t_1$, and on the footprint of detector 34*b* at a subsequent time $t_3$. Since the spacing between the detectors and their resulting footprints is known, the interval between times $t_1$ and $t_3$ represents vehicle speed. As shown in FIG. 12, where a third detector 34*c* is also used, two velocity measurements are made, and they can be used to calculate a vehicle's acceleration or deceleration.

The length of a vehicle is a function of the period between time $t_1$ and $t_2$. The longer the vehicle, the longer the period. As represented by the signal G3 in FIG. 8, passage of a vehicle V3 is shown to take a longer period of time than a following vehicle V2. There are three basic classifications of vehicles, and these are based upon vehicle length. A first classification is passenger vehicles and small vans such as represented by the vehicles V1, V4, and V5 in FIG. 2. These are the shortest length vehicles and when their passage is detected, they will result in the shortest interval between times $t_1$ and $t_2$. At the opposite end, are large trucks such as semis and large busses, such as represented by vehicle V3 in FIG. 2. These would produce the longest interval between times $t_1$ and $t_2$. Intermediate these extremes, are vehicles such as small trucks, vans, and small busses as represented by the vehicle V2 in FIG. 2. The time interval between times $t_1$ and $t_2$ for these intermediate size vehicles falls between the interval for the other two classes of vehicles. With respect to vehicle length, a medium size passenger car has a length, in general, of approximately 18 feet. Apparatus 10, for example, will determine vehicle speeds at up to 100 miles per hour (≈147 ft./sec.). It will be recalled that footprint 30 is 2.3 feet on each side. Accordingly, at 100 miles per hour, such a vehicle would be within the footprint for approximately 0.14 sec. That is, $$(18'+2.3')/(147'/\text{sec.})=0.14 \text{ sec.}$$

It will also be recalled that apparatus 10 has a response time on the order of 0.01 sec. Accordingly, the vehicle will be present in the footprint approximately 14 times the resolution of the system; and as such, should be readily detectable.

With respect to the information derived by processor 52, highway traffic controllers for a road system such as shown in FIG. 9 establish vehicle rates for various portions of the system during different times of the day. At peak times, these rates are higher than for other periods. Rather than being constantly provided with traffic flow information, the controllers can establish the appropriate thresholds. And, current measured flow rates can be compared against them. Only if the vehicle flow rate falls below a preset threshold would something typically need to be done to alter traffic flow over the road system. Otherwise, it is a reasonable presumption that if the flow rates exceed the threshold, there are no significant problems which need to be dealt with. If, however, problems do arise because of vehicle breakdown, a traffic accident, or simply because of a high volume of traffic, the operation of apparatus 10 is such that an appropriate indication is provided to the controllers. For example, as shown in FIG. 11, if the vehicles are stopped or moving slowly, a queue of vehicles will form. In FIG. 11, such a queue includes vehicles V6–V8. Where two sets of light sources and detectors are spaced sufficiently apart in a lane, the presence of such a queue is readily detectable. In such circumstances, the two sets are spaced apart a distance greater than the length of one vehicle. In FIG. 11, for example, the spacing is two vehicles.

By sensing the presence, or build up of traffic, controllers can modify traffic controls such as stop lights in an attempt to move traffic as efficiently as possible under the circumstances. If possible, it will allow the controllers to shunt a portion of the traffic about the point or points where problems have arisen. This may mean closing stretches of the road system to additional traffic until the particular problems have been corrected. It is a conundrum of highway traffic control that, even though alternate routes are usually available in any traffic situation, drivers are reluctant to take these routes, but rather tend to travel the routes which they routinely take. Often, this habitual use of a given route only serves to exacerbate whatever problems have been created. Apparatus 10 has the advantage of providing controllers sufficient and up-to-the-minute information that allows the controllers to make informed judgments as to what alternatives are possible to ameliorate a given situation and alter traffic flow patterns so the problem is resolved as quickly as possible.

What has been described is apparatus for sensing vehicular traffic passing over a roadway. The apparatus is designed to be readily installed in numerous locations on existing highway or street light standards so as to be positioned above the road. A particular advantage of the apparatus is that the installation does not require any preparatory or other work be done to the roadway. Further, the apparatus is not effected by any subsequent work done on the road after installation. In addition, the apparatus is readily movable from one installation to another installation, if required. The apparatus is a non-imaging vehicle counting and classification apparatus capable of identifying the passage of vehicles and classifying vehicles as to type. The apparatus has a light sensor or detector sensitive to changes in ambient light conditions and changes in light reflected off the surface of a roadway for detecting the passage of a vehicle. The apparatus is used to determine the length of a vehicle as a function of the amount of time a change from ambient light conditions occur. The apparatus uses standard highway light sources such as mercury vapor and sodium vapor lamps which are currently used to light intersections, and on and off-ramps at night. Use of such light sources simply requires that they be on around the clock, rather than the dusk to dawn period they are currently in use. By employing separate detectors arranged in tandem, the speed and acceleration of a vehicle passing beneath the detectors is ascertained. Also, by employing separate detectors for each lane of a multi-lane road, complete coverage of vehicles passing over the road is obtained. Use of multiple sets of sources and detectors in a lane allows vehicle queues to be detected. Operation of the apparatus requires the establishment of a baseline which is a function of current ambient light conditions. This baseline is periodically updated to take into account changes in ambient light conditions due to changing atmospheric conditions or the transition from day to night. Sensors employed by the apparatus define a footprint for a traffic lane sufficiently large so every vehicle passing over the road is detected regardless of the portion of the road over which the vehicle is traveling. By defining the footprints for adjacent lanes so they are sufficiently close together, even a vehicle changing lanes as it is passes beneath the detectors will still be detected. The detectors are impervious to extraneous light sources such as vehicle headlights to detect a vehicle. The light sources and detectors are installed on existing light standards mounted beside roadways so as to be positioned over the roadway. As such, they do not require separate supports. Also, the apparatus uses existing light sources installed on the standard as a light source by which the apparatus detects vehicles, and in particular, certain characteristics of the light source for vehicle sensing purposes. This simplifies the design and operation of the apparatus. The result is a vehicle sensing apparatus which is low in cost, relatively maintenance free, and highly reliable.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. Apparatus monitoring vehicle usage of a multi-lane roadway comprising:

at least one AC powered light source for each roadway lane, and means for powering each of said light sources;

means for mounting said light sources above a multi-lane roadway surface such that incident light from said light sources is directed downwardly onto said surface and reflected off said surface, the incident light having a predetermined waveform amplitude which is a function of the AC power source for the light source;

at least one detector means for detecting the passage of a vehicle regardless of the lane in which the vehicle is traveling, each detector including a single optical detector detecting said reflected light, the incident light from each light source and the optical characteristics of an associated optical detector define a footprint on the respective lanes of the roadway over which vehicles pass, the waveform amplitude of the reflected light being varied in response to reflection of the light from the roadway surface and passage of a vehicle over said footprint on the roadway and through a path of light between the light source and said detector means, said detector means capable of observing said waveform amplitude, the reflected light from said roadway surface also effected by changes in ambient atmospheric conditions including light from the headlights of a vehicle, each detector means capable of detecting the change effects, and including means for changing a threshold of light detection as a function of changes in the ambient light conditions and the transition from day to night and vice versa; and a processor means for processing the reflected light and any variation in the waveform amplitude of the AC component of the light caused by passage of a vehicle over the roadway to determine the number of vehicles passing over the roadway surface during a predetermined period of time thereby for a traffic controller to control traffic flow of vehicles over the roadway.

2. Apparatus for monitoring vehicle highway usage and for providing information indicative of the passage of a vehicle over the highway, the type of vehicle, and the vehicle's speed, comprising:

a light source providing light having a predetermined set of light characteristics;

means for mounting said light source above the highway with said light source directing its lumination downwardly onto the highway with incident light from said light source being reflected off a surface of the highway;

first detector means, a second detector means, and a third detector means for detecting reflected light from said light source, the reflected light from said surface having light characteristics which vary in response to passage of a vehicle over the highway and through respective first and second paths of light which are created between said light source and the respective detector means; and, processor means processing reflected light detected by each of said detector means and variations in the light characteristics thereof caused by passage of a vehicle, said processor means processing said detected light to determine passage of a vehicle, the vehicle type, and the vehicle's speed, and vehicle acceleration to enable a traffic controller to determine highway usage at any given time and control traffic flow of vehicles over the highway.

3. A method of monitoring vehicle usage on a multi-lane roadway comprising:

mounting at least one light source above each lane of the roadway and emitting light from the light source such that the light is directed downwardly onto the roadway with incident light from the light source being reflected off a surface of the roadway;

detecting through at least one optical detector for each lane, emitted light from the light source associated with each lane reflected off the roadway surface and ambient light on the roadway surface including light from vehicle headlights, each optical detector and the light from each associated light source directed at the roadway surface defining a footprint on the roadway surface over which vehicles pass, the reflected light having an AC ripple, whose amplitude is a function of an AC power source for the light, said amplitude varying in response to reflection of the light from the roadway surface and the passage of a vehicle over the defined footprint and through a path of light between the light source and the optical detector;

adjusting a threshold of light detection in accordance with changes in the ambient light conditions and the change from day to night and vice versa;

filtering the detected light to filter out light of a wavelength other than that from each light source;

amplifying said filtered light to produce an analog output signal;

converting said analog output signal to a digital signal; and processing the digital signal to detect variations in the amplitude of the AC ripple caused by the passage of a vehicle to determine the number, speed, and type of vehicles passing over each lane of the roadway during a predetermined period of time, regardless of the lane in which the vehicles travel.

4. A method for detecting vehicle usage passage over a road and for determining the type of vehicle and the vehicle's speed comprising:

providing an AC light source;

powering said light source from an AC power source;

mounting said light source above the road for light from said light source to be directed downwardly onto a road surface with incident light from said source being reflected off the surface, incident light from said light source including an AC ripple whose frequency is a function of the AC power source;

detecting light from said light source using a first detector means, a second detector means, and a third detector means, the amplitude of the AC ripple in the light reflected from the road varying in response to passage of a vehicle over the road and through respective paths of light created between said light source and each of the respective detector means; and, processing said detected light using processor means processing the reflected light detected by each from each of said detector means and variations in the amplitude of the AC ripple caused by passage of a vehicle, said processing of said detected light providing information used to determine passage of a vehicle, the vehicle's type, and the vehicle's speed and acceleration.

5. In a multi-lane highway over which different types of vehicles travel, the volume of vehicles traveling over the highway differing at different times of the day and night, and the speed and acceleration of the vehicles also differing, a method for determining the vehicle usage at any one time for a highway controller to control traffic flow of vehicles over the highway comprising:

installing an AC light source over each lane of the highway;

supplying AC power to the light sources to power the lights;

mounting respective first and second light detector means with each said light source;

linearly spacing the respective detector means apart from their associated light source along a longitudinal centerline of the lane;

directing light from each light source downwardly onto a surface of the highway with incident light from each source being reflected off the highway surface, the incident light from each light source including an AC ripple whose frequency is a function of the AC power source;

detecting the reflected light from each light source using said first and second light detector means, the amplitude of the AC ripple in the reflected light varying in response to passage of a vehicle over the highway and through respective first and second non-convergent paths of light created by a light source and said detector means;

adjusting a threshold of light detection of the detector means as a function of changes in ambient light conditions and the transition from day to night and vice versa; and, processing the reflected light detected from the respective detector means and variations in the AC ripple therein caused by passage of a vehicle, processing of the detected light by the processor means being used to determine passage of the vehicle, the vehicle type, and the vehicle's speed thereby to enable a traffic controller to control traffic flow.

* * * * *